US009465362B2

(12) United States Patent
Cusin

(10) Patent No.: US 9,465,362 B2
(45) Date of Patent: Oct. 11, 2016

(54) OSCILLATOR WITH A DETENT ESCAPEMENT

(71) Applicant: Nivarox-FAR S.A., Le Locle (CH)

(72) Inventor: Pierre Cusin, Villars-Burquin (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 15/019,495

(22) Filed: Feb. 9, 2016

(65) Prior Publication Data

US 2016/0246257 A1 Aug. 25, 2016

(30) Foreign Application Priority Data

Feb. 20, 2015 (EP) ..... 15155874

(51) Int. Cl.
*G04B 15/14* (2006.01)
*G04B 17/10* (2006.01)
*G04B 17/04* (2006.01)

(52) U.S. Cl.
CPC ..... *G04B 15/14* (2013.01); *G04B 17/04* (2013.01); *G04B 17/045* (2013.01); *G04B 17/10* (2013.01)

(58) Field of Classification Search
CPC ..... G04B 15/06; G04B 15/14; G04B 17/04; G04B 17/045; G04B 17/10
See application file for complete search history.

(56) References Cited

U.S. PATENT DOCUMENTS 965,506 A * 7/1910 Ecaubert ..... G04B 17/222 368/171
2005/0217169 A1* 10/2005 Kunz ..... G04B 13/02 47/33
2007/0287930 A1* 12/2007 Sutton ..... A61M 21/00 600/544
2009/0245030 A1* 10/2009 Buhler ..... G04B 17/066 368/177
2011/0103197 A1 5/2011 Buhler et al.
2012/0014229 A1* 1/2012 Mallet ..... G04B 18/006 368/175
2012/0063273 A1 3/2012 Koda et al.
2012/0218870 A1 8/2012 Koda et al.
2013/0070570 A1 3/2013 Colpo et al.
2013/0176829 A1 7/2013 Cusin et al.

FOREIGN PATENT DOCUMENTS

EP 2 037 335 A2 3/2009
EP 2 104 008 A1 9/2009
WO WO 2011/120180 A1 10/2011
WO WO 2012/010408 A1 1/2012

OTHER PUBLICATIONS

European Search Report with written opinion issued Oct. 27, 2015 in European application 15155874.9 filed on Feb. 20, 2015 (with English Translation).

* cited by examiner

*Primary Examiner* — Vit W Miska
(74) *Attorney, Agent, or Firm* — Oblon, McClelland, Maier & Neustadt, L.L.P

(57) ABSTRACT

The invention relates to an oscillator comprising a resonator of the inertia-elasticity type cooperating with a detent escapement comprising a detent cooperating with an escape wheel. The resonator is in one-piece and includes an inertia member and a first flexible structure providing the elasticity and forming a virtual pivot axis of the resonator and the detent is in one-piece and includes an unlocking spring and a second flexible structure forming a virtual pivot axis of the detent.

21 Claims, 6 Drawing Sheets

OSCILLATOR WITH A DETENT ESCAPEMENT

This application claims priority from European Patent Application No. 15155874.9 filed Feb. 20, 2015, the entire disclosure of which is hereby incorporated herein by reference.

FIELD OF THE INVENTION

The invention relates to an oscillator comprising a resonator of the inertia-elasticity type cooperating with a detent escapement.

BACKGROUND OF THE INVENTION

Detent escapement systems are known for having brought high precision to marine chronometers in the 18th century by offering a direct impulse and low sensitivity to friction. However, they proved particularly difficult to adjust and sensitive to shocks. Certain marine chronometers have therefore been mounted in a vacuum, in sand or even in gimbal suspensions to prevent the transmission of any shocks causing tripping, i.e. the accidental passing of two escape wheel teeth instead of one, likely to disturb the operation of the timepiece. Thus, given the sensitivity to shocks and the space required for such assemblies, it is currently impossible to envisage implementing a reliable detent escapement in a wristwatch.

SUMMARY OF THE INVENTION

It is an object of the present invention to overcome all or part of the aforecited drawbacks by proposing an oscillator comprising a resonator of the inertia-elasticity type, cooperating with a detent escapement, which is reliable, compact, not subject to tripping and whose organs are very precisely positioned in relation to each other.

To this end, the invention relates to an oscillator comprising a resonator of the inertia-elasticity type cooperating with a detent escapement comprising a detent cooperating with an escape wheel, characterized in that the resonator is in one-piece and comprises an inertia member and a first flexible structure or bearing providing the elasticity of the resonator and forming a virtual pivot axis of the resonator, in that the detent is also made in one-piece and comprises a body forming a locking-stone, or locking pallet, cooperating with the escape wheel, a second flexible structure or bearing forming a virtual pivot axis of the detent and an unlocking spring cooperating with a stop member formed at one end of the body of the detent and in that the inertia member forms an impulse-pallet cooperating with the escape wheel and a discharging-pallet cooperating with the unlocking spring.

Advantageously according to the invention, it is thus clear that the oscillator includes very few components for mounting since they are mostly one-piece components, which also means that the elements of the components are already perfectly referenced in relation to each other. Further, the oscillator is very compact owing to the use of flexible structures, also called monolithic articulated structures, which decreases the required thickness by dispensing with the use of pivots and intrinsically results in the elimination of tripping. Further, the oscillator of the invention advantageously increases the frequency of the resonator without decreasing the overall oscillator efficiency in comparison to an oscillator using a Swiss lever escapement. Consequently, the oscillator of the invention is sufficiently compact and reliable to be considered for application to a wristwatch.

In accordance with other advantageous variants of the invention:

- the one-piece resonator is formed in first and second integral layers, the first level comprising the inertia member provided with the impulse-pallet and the second level comprising the first flexible structure and the discharging-pallet;
- according to a first embodiment, the inertia member is formed by a ring, with the peripheral surface of said ring comprising the impulse-pallet;
- the first flexible structure comprises at least one anchoring means integral, via flexible means, with two arcs connected by a crosspiece, said flexible means being arranged to form said virtual pivot axis of the resonator at the centre of the crosspiece;
- the flexible means comprise at least one base respectively connecting each of the two arcs and said at least one anchoring means, via at least one flexible strip;
- according to a second embodiment, the inertia member is formed by two sectors connected by a bar, the peripheral surface of one of the sectors comprising the impulse-pallet;
- the first flexible structure comprises at least one anchoring means integral, via flexible means, with two arcs connected by a crosspiece, said flexible means being arranged to form said virtual pivot axis of the resonator at the centre of the crosspiece;
- the flexible means comprise at least one base respectively connecting each of the two arcs and said at least one anchoring means, via at least one flexible strip;
- according to both embodiments, the first flexible structure further comprises at least one stop member arranged to enter into contact with said at least one anchoring means in order to limit the amplitude of the resonator;
- the one-piece detent is formed in first and second integral planes, the first plane comprising the body having a lateral surface which includes the locking-stone and the second plane comprising the second flexible structure, the unlocking spring and the stop member;
- the second flexible structure comprises at least two securing means integral, via flexible means, with a base element, said flexible means being arranged to form said virtual pivot axis of said detent at the centre of the base element;
- the flexible means of the second flexible structure comprise at least one flexible strip;
- the unlocking spring is integral with the base element and cooperates with the stop member to leave the detent body unrestricted in a first direction of rotation of the resonator and to make the detent move integrally in a second direction of rotation of the resonator through contact with the discharging-pallet of the resonator;
- the one-piece resonator and the one-piece detent are formed in two single plates joined to form a one-piece oscillator assembly in which the resonator and the detent are ideally referenced in relation to each other;
- one of the two plates comprises a bearing for receiving the escape wheel so that the latter is ideally referenced in relation to the one-piece oscillator assembly;
- one of the two plates comprises at least two securing means arranged to attach the oscillator on a main plate;
- the oscillator further comprises anti-unlocking means arranged to limit the amplitude of the motions of the detent;

the oscillator further comprises prestress means arranged to place the second flexible structure under stress even when the detent is in the locking position.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
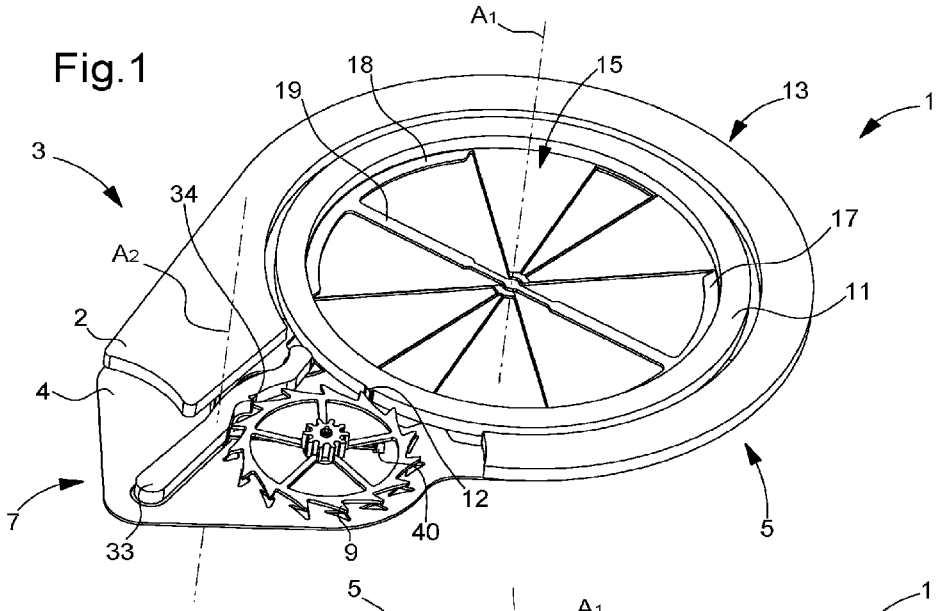
FIG. 1 is a perspective view of a first embodiment of an oscillator according to the invention.

The invention relates to an oscillator for a timepiece, i.e. a resonator coupled with a distribution and maintenance system such as, for example, an escapement system. According to the invention, the oscillator includes a resonator of the inertia-elasticity type which cooperates with a detent escapement. The latter comprises a detent which cooperates with an escape wheel.

Advantageously according to the invention, the resonator is in one-piece. The resonator thus includes, in one piece, an inertia member and a first flexible structure or bearing. The latter provides the elasticity of the resonator and forms a virtual pivot axis of the resonator which avoids the use of the ordinary bearings and pivot. However, on the other hand, the amplitude of the resonator is limited to the maximum range of motion of the first flexible structure or bearing. Nevertheless, this limitation of motion makes it intrinsically impossible for the resonator to trip, which, by design, resolves the main problem that usually penalizes detent escapement mechanisms.

Further, the detent is also in one-piece according to the invention. It therefore includes, in one piece, a body, a second flexible structure or bearing and an unlocking spring cooperating with a stop member formed at one end of the detent body. This assembly is usually very difficult to adjust and the one-piece aspect according to the invention is advantageous as regards the positioning precision of the assembly.

The detent body is provided with a one-piece locking-stone, or locking pallet, that cooperates with the escape wheel, which avoids the use of an additional impulse pin and contact with the escape wheel in a different plane from the detent body. According to the invention, the second flexible structure body forms a virtual pivot axis of the detent. As with the first flexible structure, the second flexible structure avoids the need to use the usual bearings and pivot. Finally, the unlocking spring cooperates with a stop member formed at one end of the detent body.

In order to further improve compactness, the inertia member is directly provided with an impulse-pallet, i.e. the impulse-pallet is in one-piece with the inertia member. Further, the impulse-pallet cooperates directly with the escape wheel. It is understood that no intermediate part is used between the inertia member and the escape wheel rendering the impulse even more direct than an ordinary detent escapement mechanism.

Finally, the inertia member is also directly provided with a discharging-pallet, i.e. the discharging-pallet is also in one-piece with the inertia member. Further, the discharging-pallet cooperates directly with the unlocking spring. Similarly to the impulse-pallet, it is thus understood that no intermediate part is used between the inertia member and the unlocking spring, rendering the unlocking more compact and even more direct relative to an ordinary detent escapement system.

Advantageously according to the invention, the one-piece resonator is formed in first and second integral levels and the one-piece detent is formed in first and second integral planes, the first and second levels being respectively coplanar with or offset from the first and second planes. It is understood that the thickness of the resulting assembly can be drastically decreased relative to an oscillator using an ordinary sprung balance resonator cooperating with an ordinary detent escapement system.

Advantageously according to the invention, it is thus understood that the one-piece resonator and the one-piece detent can be formed as two single plates or wafers joined to form a one-piece oscillator assembly in which the resonator and the detent are ideally referenced in relation to each other. This provides the immediate advantage of a perfectly referenced assembly which is mounted in one piece in the timepiece movement without requiring any particular precautions or fine adjustments to be observed.

This one-piece oscillator assembly could, for example, be made from joined silicon-based plates, such as typically a silicon on insulator substrate (also called "S.O.I."). However, any materials that can be secured to each other and subsequently etched face-to-face, such as a silicon on insulator substrate, may be used.

Two embodiments are shown in FIGS. 1 to 11 to better explain the advantages of the invention. According to the first embodiment of the invention illustrated in FIGS. 1 to 6, oscillator 1 comprises a one-piece oscillator assembly 3 formed integrally with a one-piece resonator 5 and a one-piece detent 7 and only in first and second integral plates 2, 4. Further, oscillator 1 comprises an escape wheel 9 which is placed in an aperture 6 of second plate 4.

One-piece resonator 5 is formed in first and second integral levels, the first level comprising inertia member 11 provided with impulse-pallet 12 and the second level comprising a first flexible structure 13 and discharging-pallet 14. As visible in FIGS. 1, 2 and 4, impulse-pallet 12 is in one-piece on the peripheral surface of inertia member 11 formed by a ring.

First flexible structure 13 includes at least one anchoring means 16 integral, via flexible means 15, with two arcs 17, 18 connected by a crosspiece 19, said flexible means 15 being arranged to form a virtual pivot axis $A_1$ of resonator 5 at the centre of crosspiece 19.

Figure 2:
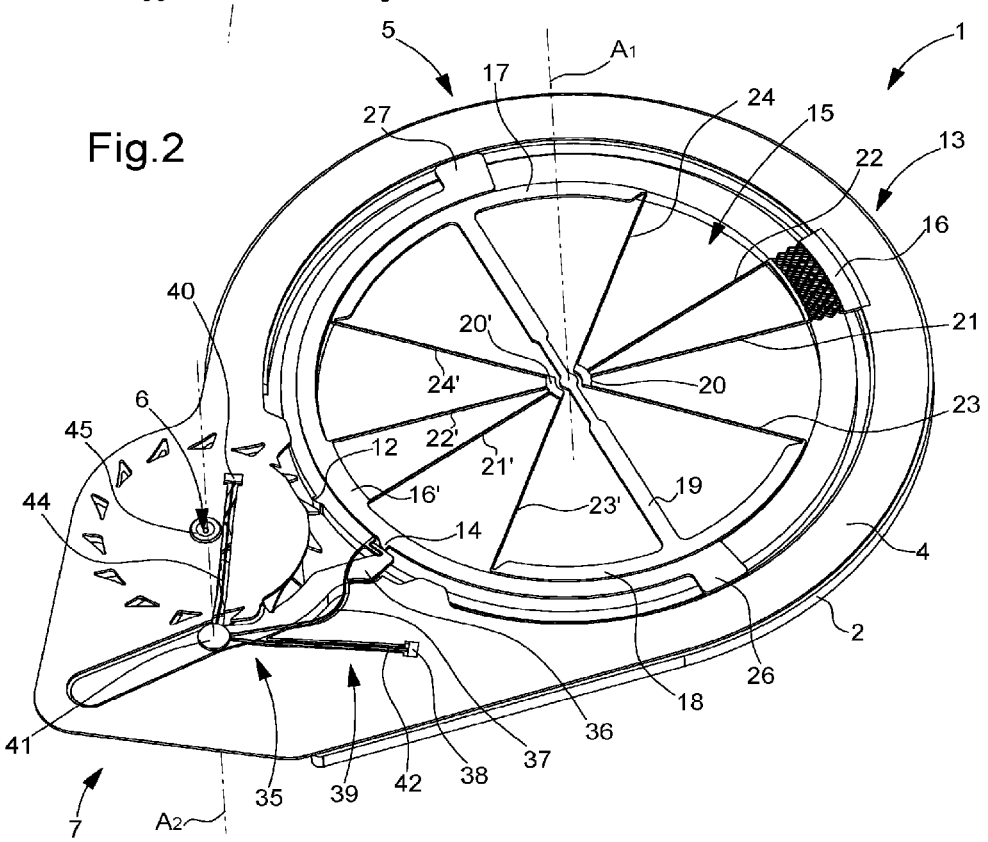
FIG. 2 is an upside down view of FIG. 1.

Further, flexible means 15 comprise at least one base 20, 20' respectively connecting each of the two arcs 17, 18 and said at least one anchoring means 16, via at least one flexible strip 21, 21', 22, 22', 23, 23', 24, 24'. In the first embodiment, it is noted that only one anchoring means 16 is used, seen more clearly in FIG. 5. Anchoring means 16, integral with second plate 4, is connected to flexible strips 21, 22 by a trellis 25. It is noted, as seen in FIG. 2, that flexible strips 21', 22' are connected to inertia member 11 and not to a fixed point on plates 2, 4. Finally, as illustrated in FIGS. 2, 3 and 4, first flexible structure 13 further comprises at least one stop member 26, 27 arranged to enter into contact with said at least one anchoring means 16 in order to limit the amplitude of resonator 5.

Figure 3:
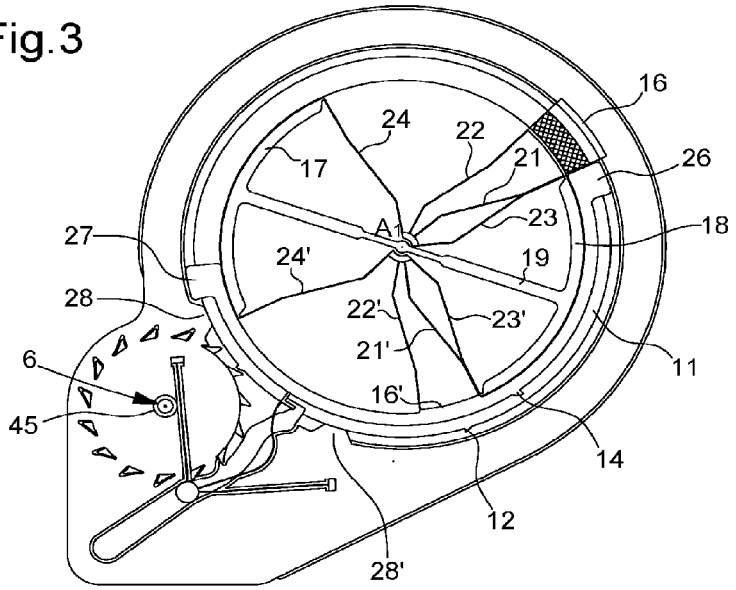
FIG. 3 is a front view of a first embodiment of an oscillator according to the invention at maximum amplitude.

An example of the maximum travel of first flexible structure 13 is shown in FIG. 3. In this extreme position of the amplitude of resonator 5, flexible strips 21-23, flexible strips 21'-23', anchoring means 16 and stop member 26, in addition to edge 28 and stop member 27, enter into contact and offer resonator 5 a secure maximum angle substantially equal to 80° of inertia member 11. Indeed, in the other direction of rotation, it is understood that in the other extreme position of the amplitude of resonator 5, flexible strips 22-24, flexible strips 22'-24', anchoring means 16 and stop member 27, in addition to edge 28' and stop member 26, enter into contact. The maximum amplitude of inertia member 11 according to the first embodiment is thus substantially equal to 160°.

Advantageously according to the invention, one-piece detent 7 is formed in first and second integral planes, the first plane comprising body 33 having a lateral surface that includes locking-stone 34 and the second plane includes second flexible structure 35, unlocking spring 37 and stop member 36.

Figure 4:
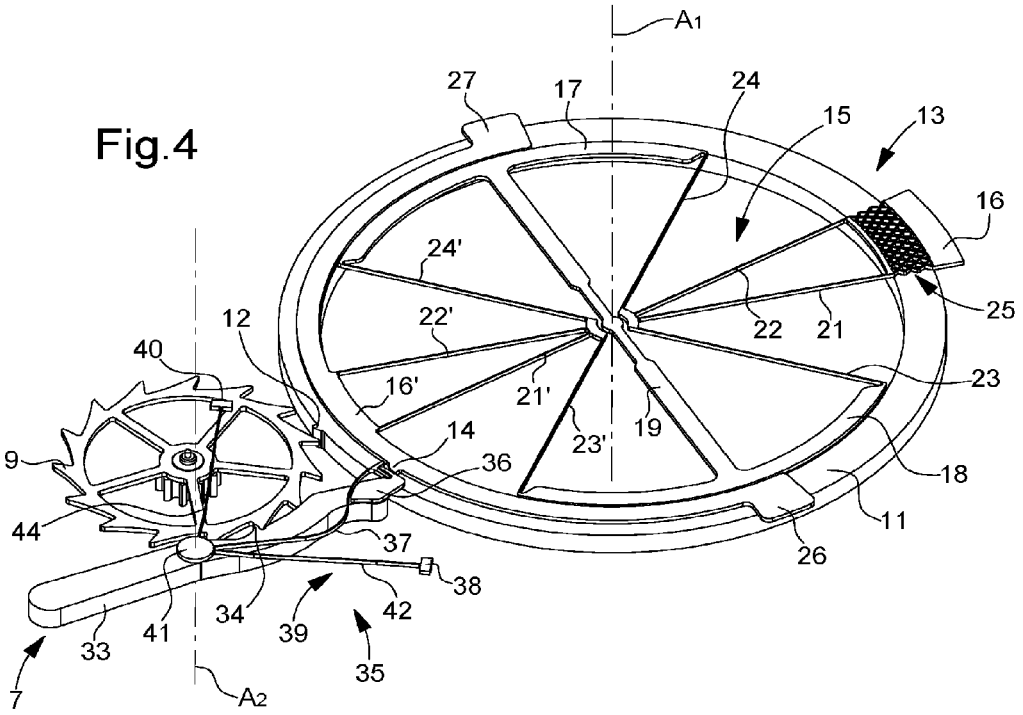
FIG. 4 is a partial view of FIG. 2.
Figure 5:
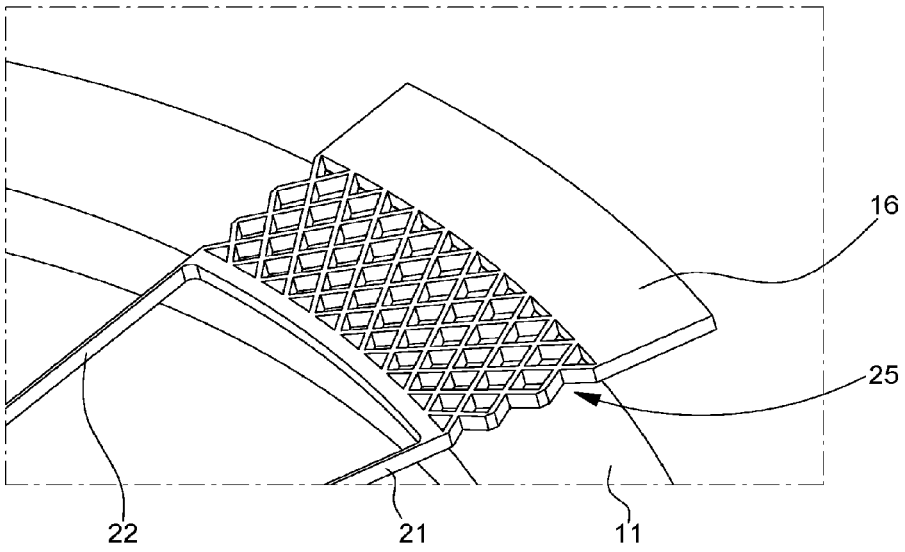
FIG. 5 is a partial view of FIG. 2 centred on an anchoring means.

As seen in FIGS. 2 and 4, second flexible structure 35 includes at least two securing means 38, 40 integral, via flexible means 39, with a base element 41, said flexible means 39 being arranged to form a virtual pivot axis $A_2$ of detent 7 at the centre of base element 41. In the first embodiment, flexible means 39 comprise at least one flexible strip 42, 44, respectively between securing means 38, 40 and base element 41.

Figure 6:
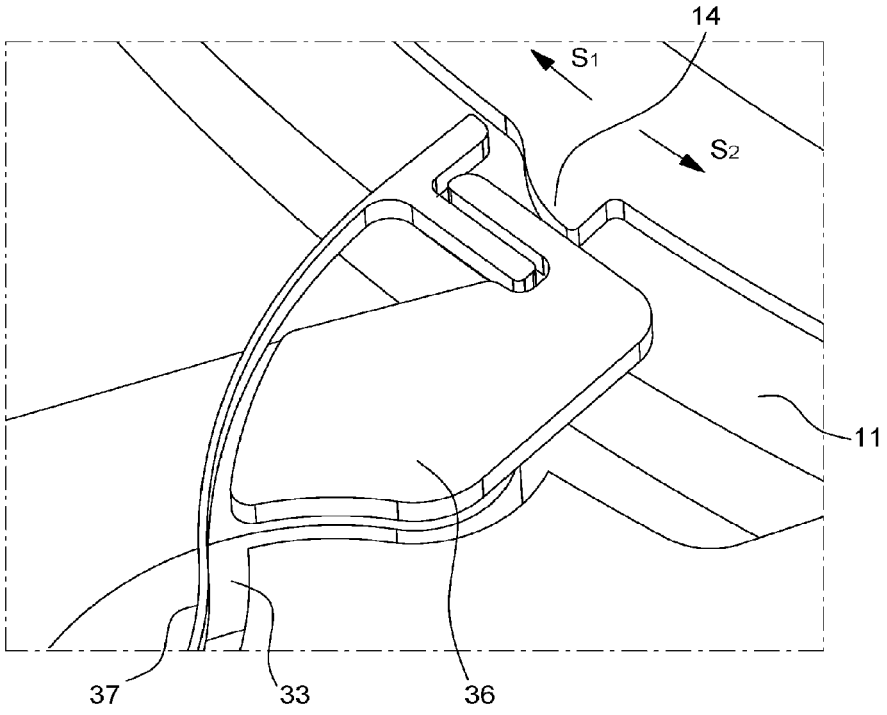
FIG. 6 is a partial view of FIG. 2 centred on the area of interaction between the resonator and the detent.
Figure 7:
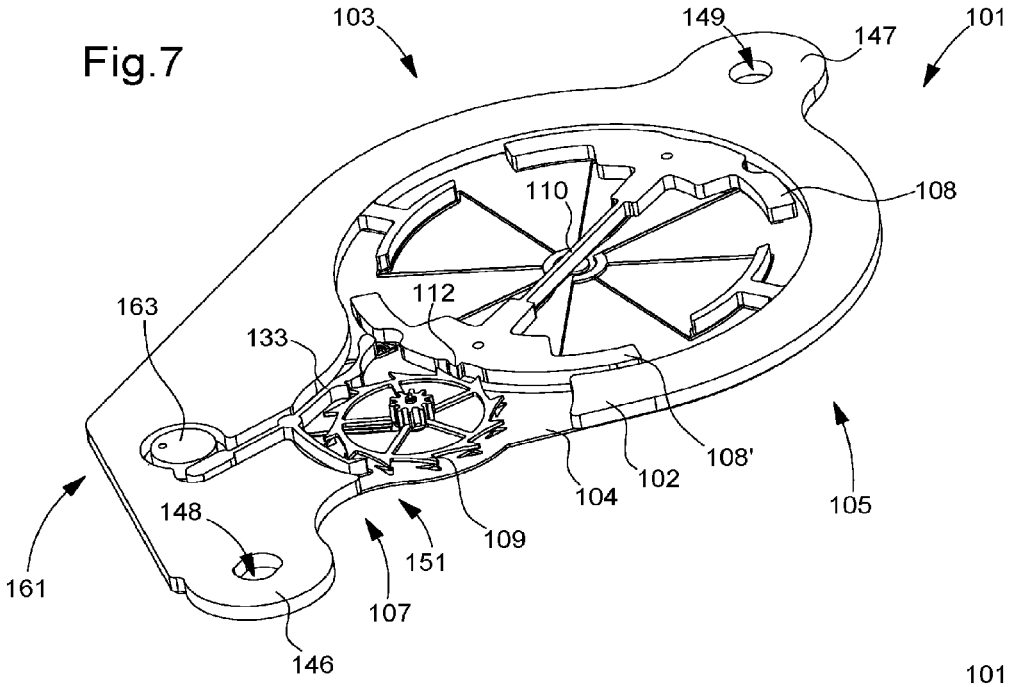
FIG. 7 is a perspective view of a second embodiment of an oscillator according to the invention.

As seen more clearly in FIGS. 4 and 6, unlocking spring 37 is integral with base element 41 and cooperates with stop member 36 in complex geometries to leave the body 33 of detent 7 unrestricted in a first direction of rotation of resonator 5 and make detent 7 move integrally in a second direction of rotation of resonator 5 through contact with discharging-pallet 14 of resonator 5.

More specifically, in direction of rotation $S_1$ of inertia member 11, as seen in FIG. 6, discharging pallet 14 will abut against the L-shaped end of unlocking spring 37 without driving stop member 36 and, incidentally, leaving body 33 of detent 7 free. However, in direction of rotation $S_2$ of inertia member 11, opposite to direction $S_1$, discharging pallet 14 will abut against the L-shaped end of unlocking spring 37 and push said L-shaped end into the U-shaped notch of stop member 36 and drive the latter and, incidentally, pivot body 33 of detent 7.

As seen in FIGS. 2 and 3, one of the two plates 2, 4 may comprise a bearing 45 for receiving the escape wheel 9 so that the latter is ideally referenced in relation to one-piece oscillator assembly 3.

According to a second embodiment of the invention illustrated in FIGS. 7 to 11, oscillator 101 comprises a one-piece oscillator assembly 103 formed integrally with a one-piece resonator 105 and a one-piece detent 107 and only in first and second integral plates 102, 104. Further, oscillator 101 comprises an escape wheel 109 which is placed in an aperture 106 of second plate 104.

Figure 9:
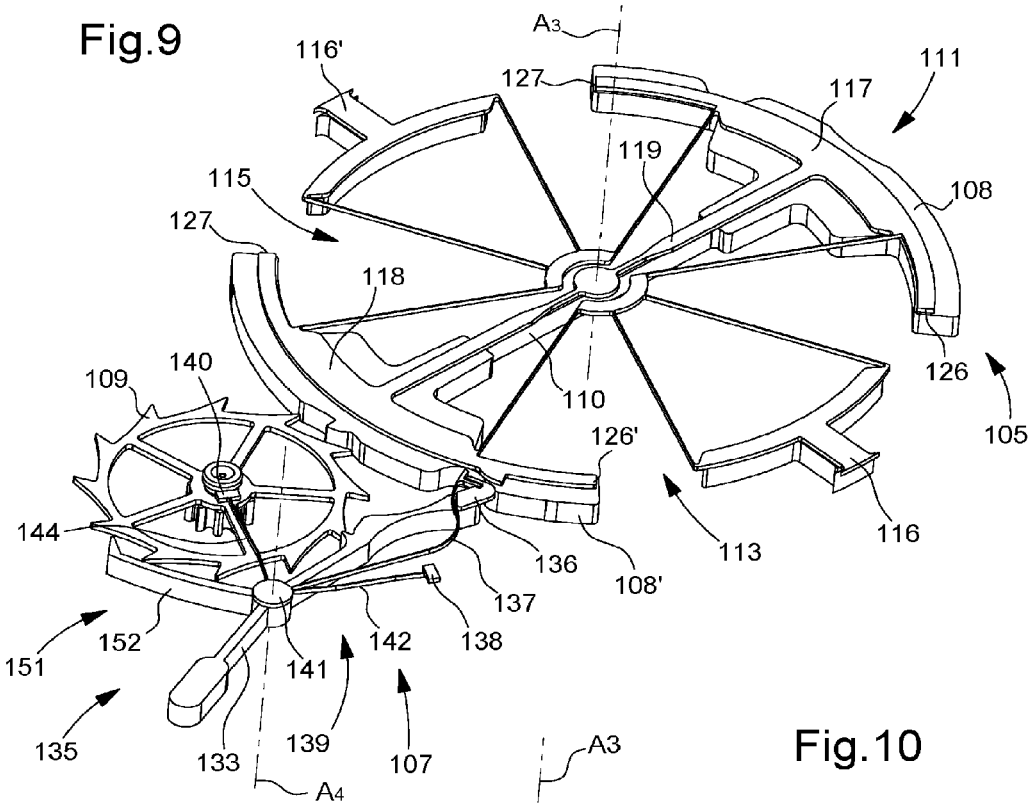
FIG. 9 is a partial view of FIG. 8.
Figure 10:
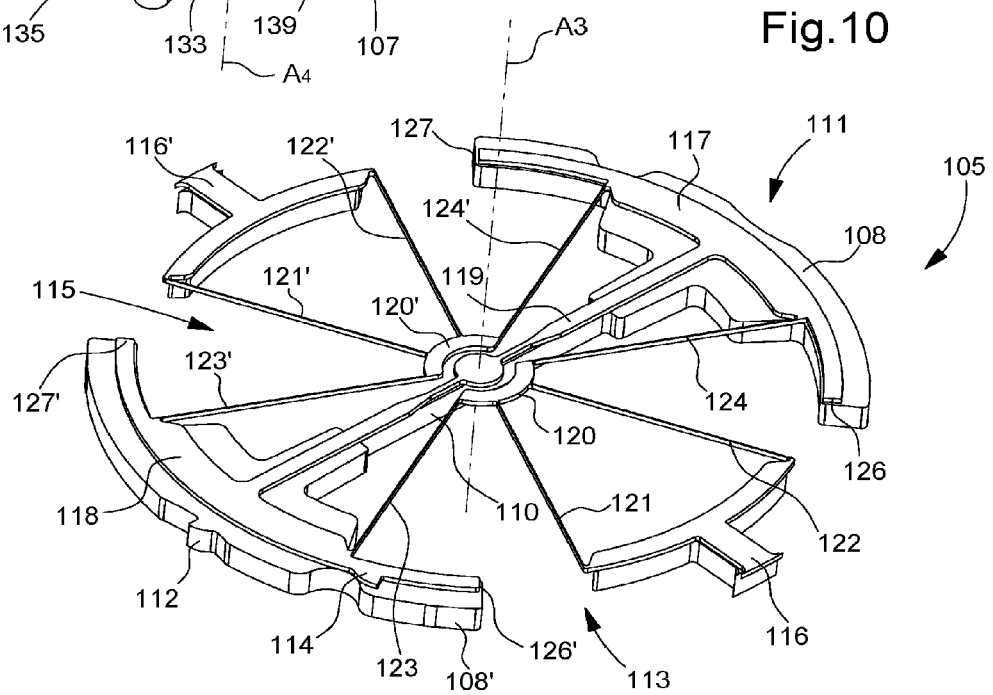
FIG. 10 is a view of a second embodiment of a resonator according to the invention.

As illustrated in FIG. 10, one-piece resonator 105 is formed in first and second integral levels, the first level comprising inertia member 111 provided with impulse-pallet 112 and the second level comprising a first flexible structure 113 and discharging-pallet 114. As seen in FIGS. 9 and 10, inertia member 11 is formed by two sectors 108, 108' connected by a bar 110, the peripheral surface of one 108' of sectors 108, 108' comprising the impulse-pallet 112.

First flexible structure 113 includes at least one anchoring means 116, 116' integral, via flexible means 115, with two arcs 117, 118 connected by a crosspiece 119, said flexible means 115 being arranged to form a virtual pivot axis $A_3$ of resonator 105 at the centre of crosspiece 119.

Figure 8:
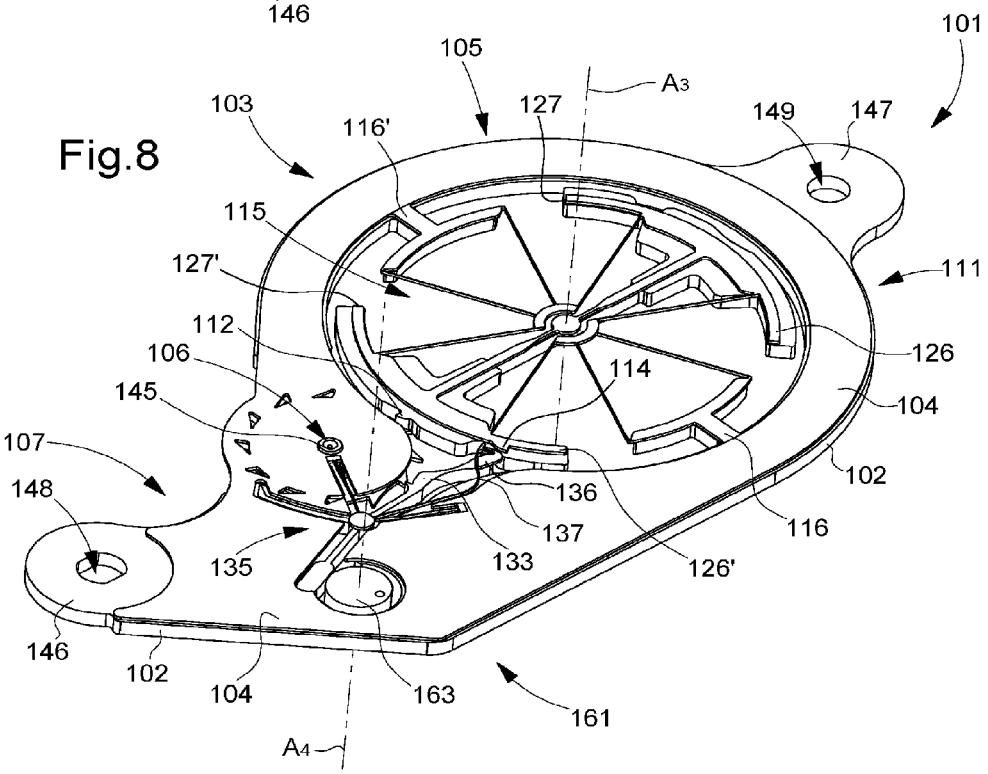
FIG. 8 is an upside down view of FIG. 7.

Further, flexible means 115 comprise at least one base 120, 120' respectively connecting each of the two arcs 117, 118 and said at least one anchoring means 116, 116' via at least one flexible strip 121, 121', 122, 122', 123, 123', 124, 124'. Anchoring means 116, 116' integral with second plate 104, are respectively connected to flexible strips 121, 121', 122, 122'. Finally, as illustrated in FIGS. 8, 9 and 10, first flexible structure 113 further comprises at least one stop member 126, 127, 126', 127' arranged to enter into contact with said at least one anchoring means 116, 116' in order to limit the amplitude of resonator 105.

Similarly to the first embodiment, in a first extreme position of the amplitude of resonator 105, flexible strips 121-123, flexible strips 122'-124', anchoring means 116, 116' and stop members 126', 127 enter into contact and offer resonator 5 a secure maximum angle substantially equal to 40° of inertia member 111. Indeed, in the other direction of rotation, it is understood that in the other extreme position of the amplitude of resonator 105, flexible strips 121'-123', flexible strips 122-124, anchoring means 116, 116' and stop members 126, 127', enter into contact. The maximum amplitude of inertia member 111 according to the second embodiment is thus substantially equal to 80°.

Advantageously according to the invention, one-piece detent 107 is formed in first and second integral planes, the first plane comprising body 133 having a lateral surface that includes locking-stone 134 and the second plane including second flexible structure 135, unlocking spring 137 and stop member 136.

Figure 11:
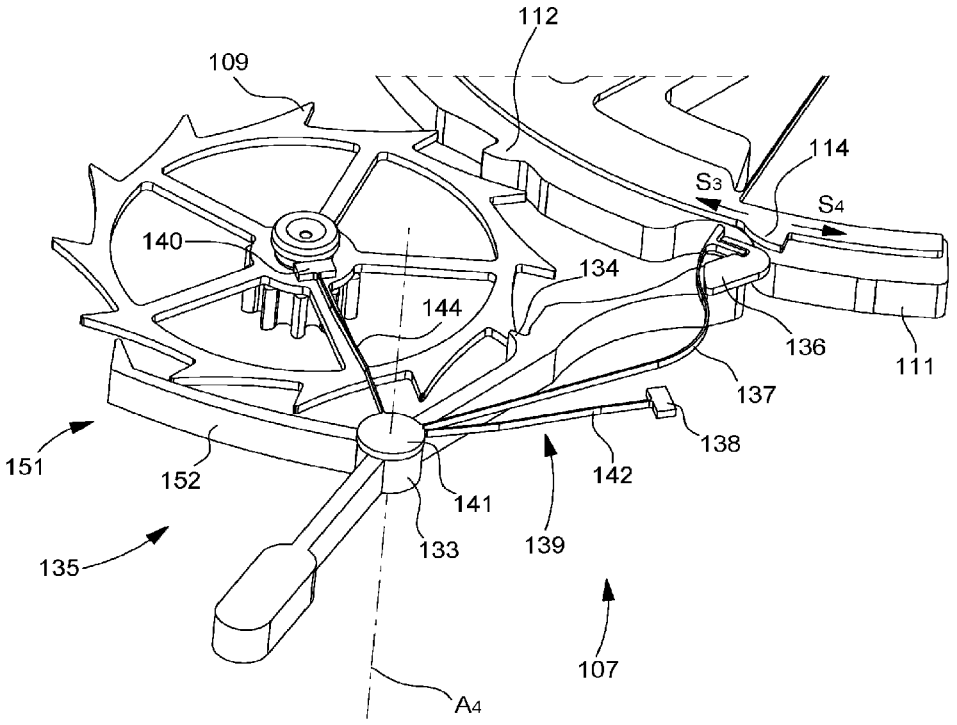
FIG. 11 is a partial view of FIG. 9 centred on the detent.

As seen in FIGS. 9 and 11, second flexible structure 135 includes at least two securing means 138, 140 integral, via flexible means 139, with a base element 141, said flexible means 139 being arranged to form a virtual pivot axis $A_4$ of detent 107 at the centre of base element 141. In the second embodiment, flexible means 139 comprise at least one flexible strip 142, 144, respectively between securing means 138, 140 and base element 141.

As seen more clearly in FIGS. 9 and 11, unlocking spring 137 is integral with base element 141 and cooperates with stop member 136 in complex geometries to leave the body 133 of detent 107 unrestricted in a first direction of rotation of resonator 105 and make detent 107 move integrally in a second direction of rotation of resonator 105 through contact with discharging-pallet 114 of resonator 105.

More specifically, in direction of rotation $S_3$ of inertia member 111, as seen in FIG. 11, discharging pallet 114 will abut against the L-shaped end of unlocking spring 137 without driving stop member 136 and, incidentally, leaving body 133 of detent 107 free. However, in direction of rotation $S_4$ of inertia member 111, opposite to direction $S_3$, discharging pallet 114 will abut against the L-shaped end of unlocking spring 137 and push said L-shaped end into the U-shaped notch of stop member 136 and drive the latter and, incidentally, pivot body 133 of detent 107.

As seen in FIG. 8, one of the two plates 102, 104 comprises a bearing 145 for receiving escape wheel 109 so that the latter is ideally referenced in relation to one-piece oscillator assembly 103. Further, one of the two plates 102, 104 comprises at least two securing means 146, 147 arranged to attach oscillator 101 on a main plate. In the example illustrated in FIGS. 7 and 8, said at least two securing means 146, 147 each includes a hole 148, 149 formed in an extension of the material of plate 102.

Advantageously according to the invention, whatever the embodiment, oscillator 1, 101 may also comprise anti-unlocking means 151 to limit the amplitude of the motions of detent 7, 107. In a non-limiting example shown in the second embodiment of FIGS. 6 to 11, anti-unlocking means 151 may, for example, comprise a safety arm 152 integral with body 133 of detent 107 and arranged to lock detent 107 against escape wheel 109 when unlocking is not desired.

Advantageously according to the invention, whatever the embodiment, oscillators 1, 101 may also comprise prestress means 161 arranged to place the second flexible structure 35, 135 under stress so that a bearing force is always maintained against the stop member. Further, second flexible structure 35, 135 has an angular stiffness providing a return torque which makes it possible to eliminate draw with respect to escape wheel 109.

In a non-limiting example shown in the second embodiment of FIGS. 6 to 11, the prestress means 161 comprise an eccentric cam 163 arranged to move body 133 of detent 107 so as to selectively modify the stress on second flexible structure 135.

The operation of oscillators 1, 101 will now be explained with reference to FIGS. 1 to 11. Oscillator 1, 101 is added, for example, to a timepiece movement with the aid of a securing system which may comprise the aforecited securing means 146, 147. Oscillator 1, 101 may advantageously be added to a main plate with, for example, a gear train placed under stress by a barrel and meshed with escape wheel 109. It is thus clear that escape wheel 109 would pivot between a bearing fitted in the main plate and bearing 45, 145.

Given the low amplitude of resonators 5, 105, oscillator 1, 101 can be started simply by being shaken. However, depending on the configuration of the final timepiece, it might be necessary to start oscillator 1, 101 manually. By way of example, the arbor of eccentric cam 163 could be manually shifted by the user so that locking-stone 34, 134 is temporarily tilted in order to provide energy from the barrel via escape wheel 9, 109 to inertia member 11, 111.

In a first direction of rotation $S_1$, $S_3$ of inertia member 11, 111 as seen in FIGS. 6 and 11, discharging-pallet 14, 114 will abut against the L-shaped end of unlocking spring 37, 137 moving gradually away from stop member 36, 136 owing to the slope of discharging-pallet 14, 114 in direction $S_1$, $S_3$. It is thus understood that, in direction $S_1$, $S_3$, the vibration is muted, i.e. resonator 5, 105 does not receive any energy.

Consequently, in direction $S_1$, $S_3$, inertia member 11, 111 leaves body 33, 133 of detent 7, 107 substantially immobile. Thus, the return of spring 37, 137 to its rest position relative to base element 41, 141 will not result in the unlocking of escape wheel 9, 109 by locking-stone 34, 134 owing to second flexible structure 35, 135 of detent 7, 107.

Inertia member 11, 111 reaches a first extreme position of the amplitude of resonator 5, 105 when first flexible structure 13, 113 of resonator 5, 105 and, possibly, stop members 26, 27, 126, 127', limit its motion. First flexible structure 13, 113 of resonator 5, 105 then forces inertia member 11, 111 to leave again in the opposite direction $S_2$, $S_4$.

In direction of rotation $S_2$, $S_4$ of inertia member 11, 111, discharging-pallet 14, 114 will abut head-on the L-shaped end of unlocking spring 37, 137 owing to the shoulder of discharging-pallet 14, 114 in direction $S_2$, $S_4$. It is understood that at the moment that discharging-pallet 14, 114 passes, it offers a contact surface substantially parallel to that of the L-shaped end of unlocking spring 37, 137, which allows the latter to be ideally directed into the U-shaped notch of stop member 36, 136 of detent 7, 107. Since stop member 36, 136 is in one-piece with body 33, 133 of detent 7, 107, discharging-pallet 14, 114 will drive detent 7, 107, countering second flexible structure 35, 135 and, incidentally, will pivot body 33, 133 of detent 7, 107.

The pivoting of body 33, 133 of detent 7, 107 relative to base element 41, 141 will allow the release of the tooth of escape wheel 9, 109 by the slipping unlocking of locking-stone 34, 134 to enable escape wheel 9, 109 to rotate with no recoil. Indeed, according to the invention, since no draw of escape wheel 9, 109 is desired on discharging-pallet 14, 114, the latter is not rectilinear but preferably curved on a predetermined radius, typically centred on the virtual axis $A_2$, $A_4$ of detent 7, 107.

According to the invention, the angle of unlocking for releasing escape wheel 9, 109 from locking-stone 34, 134, is substantially two times less than the total angle of body 33, 133 of detent 7, 107 authorised by second flexible structure 35, 135. The released escape wheel 9, 109 then catches up with impulse-pallet 12, 112 of inertia member 11, 111 to provide a part of the energy from the barrel to the resonator 5, 105 able to maintain the oscillation of resonator 5, 105. At the same time, the rotation of escape wheel 9, 109 allows time to be counted by the gear train supplying energy from the barrel to present the oscillation of resonator 5, 105 on a display device.

Advantageously according to the invention, second flexible structure 35, 135 is arranged to release only one tooth of escape wheel 9, 109 at a time via discharging-pallet 14, 114. Usually, this adjustment is made difficult by manufacturing and assembly dispersions. Advantageously according to the invention, since the manufacture and positions are very precise, unlocking can be regulated simply by the geometry of escape wheel 9, 109 and, possibly, adjustment of pre-stress means 161.

Inertia member 11, 111 reaches a second extreme position of the amplitude of resonator 5, 105 when first flexible structure 13, 113 of resonator 5, 105 and, possibly, stop members 26, 27, 126', 127, limit its motion. First flexible structure 13, 113 of resonator 5, 105 then forces inertia member 11, 111 to leave again in the opposite direction $S_1$, $S_3$. Resonator 5, 105 then makes one complete oscillation and repeats the movement explained above.

Advantageously according to the invention, it is understood therefore that oscillator 1, 101 comprises very few components requiring assembly since they are mostly in one-piece. It is thus understood according to the invention that only two (one-piece oscillator assembly 3, 103, and escape wheel 9, 109) or three (one-piece resonator 5, 105, one-piece detent 7, 107 and escape wheel 9, 109) components require assembly in the timepiece movement. Incidentally, a limit of two or three components also allows the elements of these components to be intrinsically perfectly referenced in relation to each other.

Further, oscillator 1, 101 is very compact owing to the use of flexible structures or bearings, also called monolithic articulated structures, which decreases the necessary thickness by dispensing with the use of classic bearings (such as pierced stones) and pivots. The flexible structures are also advantageously used to eliminate by design the main drawback of known detent systems, i.e. tripping. Consequently, oscillator 1, 101 of the invention is sufficiently compact and reliable to be considered for application to a wristwatch.

Of course, this invention is not limited to the illustrated example but is capable of various variants and alterations that will appear to those skilled in the art. In particular, depending on the desired application, resonator 5, 105 and/or detent 7, 107 can be modified, particularly as regards their geometry (inertia member, detent) or their flexible structures.

Further, anti-unlocking means 151 are not limited to a safety arm 152 but could, by way of example, comprise anti-inertia means arranged to block detent 7, 107 when unlocking is not desired.

It is also possible to provide shock absorber means between oscillator 1, 101 and its securing system to prevent the transmission of all shocks received by the timepiece. It is also evident that the two embodiments can be combined with each other. Thus, it is possible to envisage that resonator 5 of the first embodiment cooperates with detent 107 of the second embodiment or that prestress means 161 of the second embodiment are incorporated in the first embodiment without departing from the scope of the invention.

Finally, in order to shorten the time taken by escape wheel 9, 109 to catch up impulse-pallet 12, 112 of inertia member 11, 111, escape wheel 9, 109 may exhibit elasticity between the toothing and pinion thereof connected to the gear train of the movement. Such an escape wheel could, by way of non-limiting example, be one of the energy transmission wheel set embodiments described in EP 2,455,821 which is incorporated by reference in the present description.

What is claimed is:

1. An oscillator comprising a resonator of the inertia-elasticity type cooperating with a detent escapement comprising a detent cooperating with an escape wheel, wherein the resonator is in one-piece and comprises an inertia member and a first flexible structure providing the elasticity and forming a virtual pivot axis of the resonator, wherein the detent is in one-piece and comprises a body forming a locking-stone cooperating with the escape wheel, a second flexible structure forming a virtual pivot axis of the detent and an unlocking spring cooperating with a stop member formed at one end of the body of the detent and wherein the inertia member forms an impulse-pallet cooperating with the escape wheel and a discharging-pallet cooperating with the unlocking spring.

2. The oscillator according to claim 1, wherein the resonator is formed in first and second integral levels, the first level comprising the inertia member provided with the impulse-pallet and the second level comprising the first flexible structure and the discharging-pallet.

3. The oscillator according to claim 1, wherein the inertia member is formed by a ring, the peripheral surface of the ring comprising the impulse-pallet.

4. The oscillator according to claim 3, wherein the first flexible structure includes at least one anchoring means integral, via flexible means, with two arcs connected by a crosspiece, the flexible means being arranged to form the virtual pivot axis of the resonator at the centre of the crosspiece.

5. The oscillator according to claim 4, wherein the first flexible structure further comprises at least one stop member arranged to enter into contact with the at least one anchoring means in order to limit the amplitude of the resonator.

6. The oscillator according to claim 4, wherein the flexible means of the first flexible structure comprise at least one base respectively connecting each of the two arcs and the at least one anchoring means, via at least one flexible strip.

7. The oscillator according to claim 6, wherein the first flexible structure further comprises at least one stop member arranged to enter into contact with the at least one anchoring means in order to limit the amplitude of the resonator.

8. The oscillator according to claim 1, wherein the inertia member is formed by two sectors connected by a bar, the peripheral surface of one of the sectors comprising the impulse-pallet.

9. The oscillator according to claim 8, wherein the first flexible structure includes at least one anchoring means integral, via flexible means, with two arcs connected by a crosspiece, the flexible means being arranged to form the virtual pivot axis of the resonator at the centre of the crosspiece.

10. The oscillator according to claim 9, wherein the first flexible structure further comprises at least one stop member arranged to enter into contact with the at least one anchoring means in order to limit the amplitude of the resonator.

11. The oscillator according to claim 9, wherein the flexible means of the first flexible structure comprise at least one base respectively connecting each of the two arcs and the at least one anchoring means, via at least one flexible strip.

12. The oscillator according to claim 11, wherein the first flexible structure further comprises at least one stop member arranged to enter into contact with the at least one anchoring means in order to limit the amplitude of the resonator.

13. The oscillator according to claim 1, wherein the one-piece detent is formed in first and second integral planes, the first plane comprising the body having a lateral surface that includes the locking-stone and the second plane including the second flexible structure, the unlocking spring and the stop member.

14. The oscillator according to claim 13, wherein the second flexible structure comprises at least two securing means integral, via flexible means, with a base element, the flexible means being arranged to form the virtual pivot axis of the detent at the centre of the base element.

15. The oscillator according to claim 14, wherein the flexible means of the second flexible structure include at least one flexible strip.

16. The oscillator according to claim 14, wherein the unlocking spring is integral with the base element and cooperates with the stop member to leave the body of the detent unrestricted in a first direction of rotation of the resonator and to make the detent move integrally in a second direction of rotation of the resonator through contact with the discharging-pallet of the resonator.

17. The oscillator according to claim 1, wherein the one-piece resonator and the one-piece detent are formed as two single plates joined to form a one-piece oscillator assembly in which the resonator and the detent are ideally referenced in relation to each other.

18. The oscillator according to claim 17, wherein one of the two plates comprises a bearing for receiving the escape wheel so that the latter is ideally referenced in relation to the one-piece oscillator assembly.

19. The oscillator according to claim 17, wherein one of the two plates comprises at least two securing means arranged to attach the oscillator on a main plate.

20. The oscillator according to claim 1, wherein the oscillator also includes anti-unlocking means arranged to limit the motions of the detent.

21. The oscillator according to claim 1, wherein the oscillator also includes prestress means arranged to place the second flexible structure under stress.

* * * * *